United States Patent [19]

Breiner et al.

[11] Patent Number: 4,991,294

[45] Date of Patent: Feb. 12, 1991

[54] SWIMMING POOL LINER INSTALLATION METHOD

[75] Inventors: Jonathan A. Breiner, Indianapolis; Michael T. Walsh, Zionsville, both of Ind.

[73] Assignee: Recreonics Corporation, Indianapolis, Ind.

[21] Appl. No.: 511,849

[22] Filed: Apr. 13, 1990

Related U.S. Application Data

[63] Continuation of Ser. No. 403,763, Sep. 6, 1989, abandoned.

[51] Int. Cl.[5] ..... E04H 4/00; B23P 19/04

[52] U.S. Cl. ..... 29/897.34; 29/525.2; 29/897.1; 52/169.7

[58] Field of Search ..... 29/448, 454, 525.1, 29/525.2, 526.2, 897.1, 897.3, 897.34; 4/487, 488, 494, 510, 512, 493; 52/169.7, 250, 261, 309.11

[56] References Cited

U.S. PATENT DOCUMENTS

| | | | |
|---|---|---|---|
| 3,753,327 | 8/1973 | Orndorff | 4/510 X |
| 4,007,566 | 2/1977 | Molitor | 4/510 X |
| 4,219,894 | 9/1980 | Jakowicki | 4/494 X |
| 4,249,273 | 2/1981 | Jakowicki | 4/494 |
| 4,616,800 | 10/1986 | Scourtes et al. | 4/510 X |

*Primary Examiner*—Joseph M. Gorski
*Assistant Examiner*—Peter Dungba Vo
*Attorney, Agent, or Firm*—Woodard, Emhardt, Naughton, Moriarty & McNett

[57] ABSTRACT

A method for providing water-tight termination below normal water level of a pool lining material covering the walls of a new or existing swimming pool having a stainless steel gutter system, comprising the steps of positioning about the entire perimeter of the pool a flange that extends downwardly from the gutter flush with the pool wall; securing the flange to the pool wall; overlaying the pool lining material onto the flange; placing a water-tight gasket between the pool lining material and the flange; and compressing the pool lining material and gasket between the flange and a compression strip secured to the flange about the entire perimeter of the pool with second fastening means.

19 Claims, 2 Drawing Sheets

SWIMMING POOL LINER INSTALLATION METHOD

This application is a continuation, of application Ser. No. 07/403,763, filed Sept. 6, 1989 now abandoned.

BACKGROUND OF THE INVENTION

Architects, builders and others involved in the design, construction and operation of swimming pools are increasingly using polyvinyl chloride pool liners in new pool construction and in pool renovation projects. Such liners have become more popular in new construction in part because pool walls and bottoms are used only for support, and therefore simple, non-watertight construction is adequate. Renovating old or out-of-commission pools with pool liners is also easier. Expensive reconstruction can be eliminated if the pool liner chosen is thick and tough enough to cover cracks and other defects with a water-tight blanket.

One such pool lining material is a fabric-reinforced, polyvinyl chloride product exclusively marketed in the United States by Recreonics Corporation, 7697 Zionsville Road, Indianapolis, Indiana, under the trademark DELIFOL TM. DELIFOL TM pool lining material is comprised of a polyester mesh fabric fuse-bonded between two layers of polyvinyl chloride to form a flexible blanket of polyvinyl chloride with an inner core of polyester mesh fabric to provide elasticity and tensile strength to the product.

Sheets of the DELIFOL TM material are custom cut, fitted and bonded together on site to form a conforming, water-tight pool lining for any size or shape of new or existing swimming pool. Known polyvinyl chloride bonding techniques and water-tight installation methods for the DELIFOL TM and other pool lining materials have proven to be satisfactory for all swimming pool installations except those that have required a water-tight termination of the pool lining below the normal pool water level. Such a termination requirement would exist, for example, when the swimming pool is equipped with a stainless steel gutter system that extends below the normal pool water level. It would be desirable in such cases to terminate the pool lining material in a water-tight fashion immediately below the pool's gutter system. However, known installation methods have proven to be unsatisfactory to provide a suitable water-tight seal for the DELIFOL TM pool lining material, for example.

SUMMARY OF THE INVENTION

The disclosed and claimed invention provides a novel method of providing a water-tight termination of pool lining materials below the normal pool water level of new or existing swimming pools having stainless steel gutter systems, such as immediately below the swimming pool's stainless steel gutter system.

One embodiment of the present invention is a method for providing water-tight termination below normal water level of a pool lining material covering the walls of a new or existing swimming pool having a stainless steel gutter system, comprising the steps of positioning about the entire perimeter of the pool a continuous stainless steel flange angled to match the contour of the pool wall immediately below the gutter such that the flange extends downwardly from the gutter flush with the pool wall; securing the flange to the pool wall with first fastening means that are embedded in the pool wall; welding the flange to the gutter after the securing step with a continuous bead weld at the intersection of the flange and the gutter; overlaying the pool lining material onto the flange; placing a water-tight gasket between the pool lining material and the flange; and compressing the pool lining material and gasket between the flange and a compression strip secured to the flange about the entire perimeter of the pool with second fastening means.

Another embodiment of the present invention is a method for providing water-tight termination below normal water level of a pool lining material covering the walls of a new or existing swimming pool having a stainless steel gutter system, comprising the steps of providing about the entire perimeter of the pool a continuous stainless steel flange angled to match the contour of the pool wall immediately below the gutter such that the flange extends downwardly from the gutter flush with the pool wall; securing the flange to the pool wall with first fastening means that are embedded in the pool wall; overlaying the pool lining material onto the flange; placing a water-tight gasket between the pool lining material and the flange; and compressing the pool lining material and gasket between the flange and a compression strip secured to the flange about the entire perimeter of the pool with second fastening means.

It is an object of the present invention to provide a novel method of providing a water-tight termination of pool lining materials below the normal pool water level of new or existing swimming pools having stainless steel gutter systems, such as immediately below the swimming pool's stainless steel gutter system.

Related objects and advantages of the present invention will be apparent from the following descriptions.

DESCRIPTION OF THE PREFERRED EMBODIMENT

Figure 1:
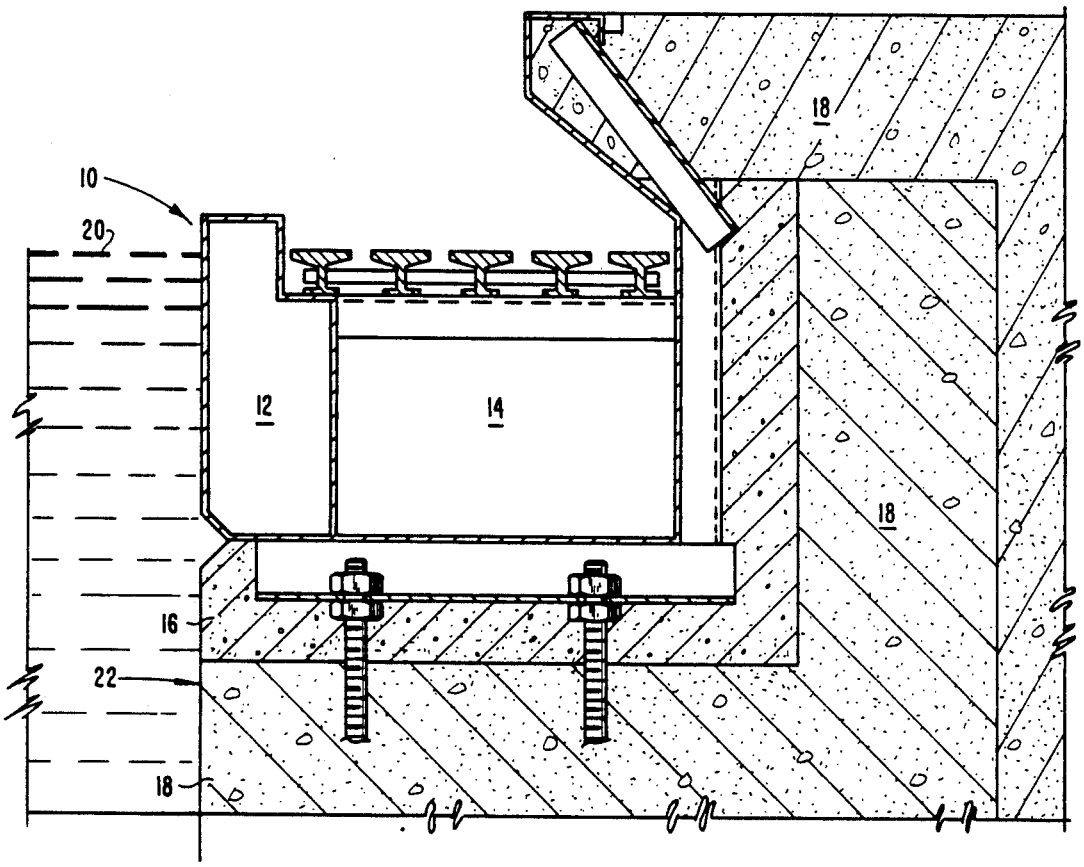
Fig.1 PRIOR ART
FIG. 1 is a cross-sectional view of a typical prior art stainless steel gutter system of a swimming pool without a pool liner of any kind.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, there is shown in FIG. 1 a cross-section of a typical stainless steel gutter 10, having a gutter trough 14 and fresh water supply tube 12, shown in its typical installed environment, surrounded by concrete grout material 16 and concrete material 18, which together define pool wall 22 below gutter 10. The typical water level within the pool under normal operating conditions is shown by line 20.

Figure 2:
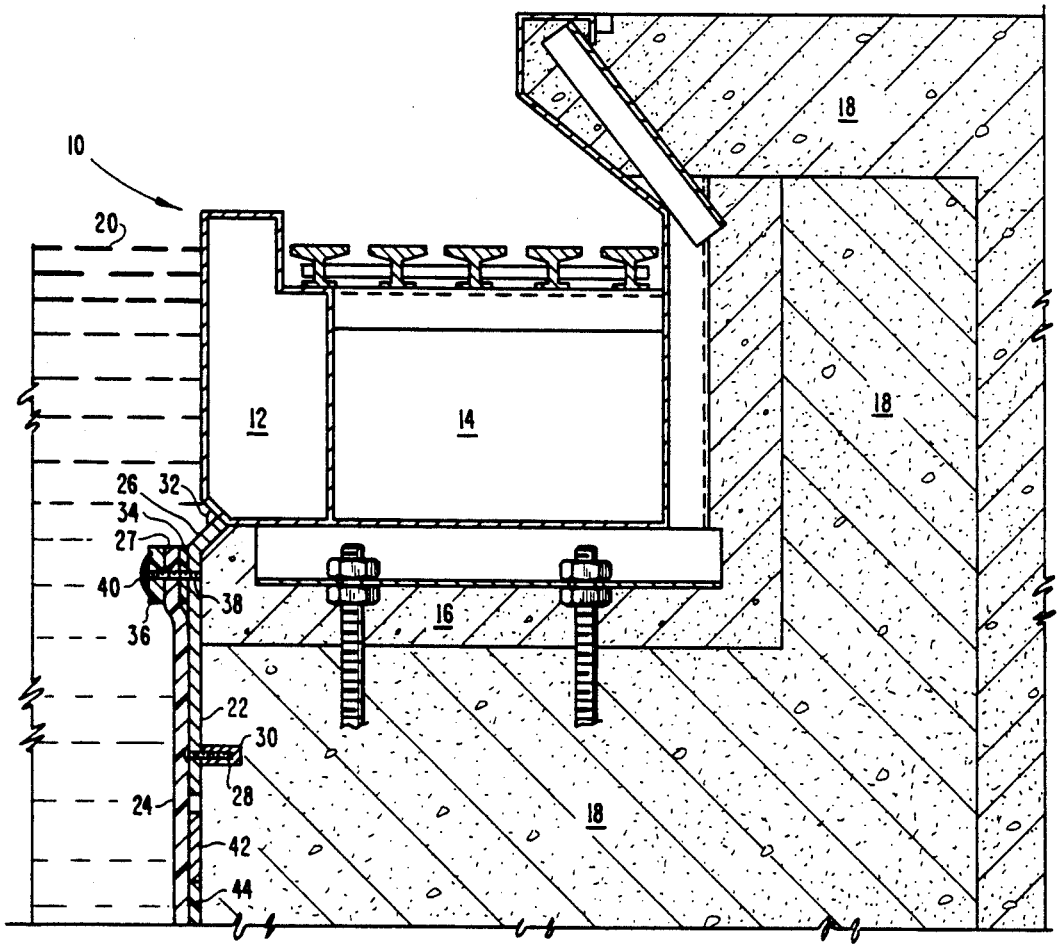
FIG. 2 is a cross-sectional view of the stainless steel gutter system of FIG. 1 which has been provided with a pool liner that has been terminated below the normal water level of the pool with a water tight seal immediately below the gutter system of FIG. 1 by the novel method of the present invention.

Referring now to FIG. 2, there is shown a cross-sectional view of the stainless steel gutter 10 of FIG. 1 with pool wall 22 now provided with a pool liner 24, such as a DELIFOL TM pool liner, for example, that has been terminated with a water tight seal along its edge 27 just below gutter 10 by the novel method of the present invention. In the preferred embodiment of the novel method of the present invention, a continuous 12 gauge, type 304, stainless steel flange 26, angled to match the contour of the pool wall 22 below supply tube 12 of gutter 10, such that its extends downwardly along and flush with the face of pool wall 22 approximately 6 inches, is positioned and secured in place about the entire perimeter of the pool by stainless steel screws 28 tapped into lead anchors 30 that are embedded in the concrete portion 18 of pool wall 22 about three inches on center. When secured in place, as described, flange 26 is then continuously bead welded 32 to gutter 10 where flange 26 meets supply tube 12. Securing flange 26 to pool wall 22 with screws 28 into lead anchors 30 before the welding step keeps the heat of the welding step from deflecting flange 26 away from its flush engagement with pool wall 22, as shown in FIG. 2.

Continuing to refer to FIG. 2, pool liner 24 is overlayed upon flange 26. A water tight gasket 34, such as a silicone sponge gasket for example, is placed between pool liner 24 and flange 26 along the edge 27 of pool liner 24 about the entire perimeter of the pool. In the preferred embodiment of the novel method of the present invention, an extruded polyvinyl chloride compression strip 36 is then positioned on the pool side of pool liner 24, and in line with gasket 34, about the entire perimeter of the pool. Compression strip 36 is held in its position and effectively compresses pool liner 24 and gasket 34 against flange 26 by stainless steel screws 38 that are tapped through compression strip 36, pool liner 24 and gasket 34, and into an anchoring relationship with flange 26. In an equally preferred embodiment of the novel method of the present invention, compression strip 36 can be fabricated from 12 gauge, type 304, stainless steel.

Optionally, an extruded polyvinyl chloride or 12 gauge, type 304, stainless steel cover strip 40 can be placed atop compression strip 36 to provide a decorative covering for screws 48. Also shown in FIG. 2 are the optional usage of double faced tape 42, such as mylar tape for example, to hold pool liner 24 in position while the steps of the above novel method are being carried out, and also the optional usage of a polyester fleece membrane 44 as an underlayer for pool liner 24.

In another embodiment of the novel method of the present invention most suitable for new pool construction, stainless steel flange 26 may be fabricated as an integral continuation of the base of gutter 10, which serves as the bottom most portion of gutter trough 14 and fresh water supply tube 12 as shown in FIG. 2. In this alternate embodiment, bead weld 32 would serve to continuously weld fresh water supply tube 12 to the base of gutter 10 at about the location where the base of gutter 10 would begin to angle downwardly along and flush with the face of pool wall 22 to form flange 26.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for providing water-tight termination below normal water level of a flexible pool lining material for a swimming pool having a stainless steel gutter about its entire perimeter, comprising the steps of:

positioning about the perimeter of a pool that is to be provided with a flexible pool lining material a continuous stainless steel flange immediately below the gutter such that the flange extends downwardly from the gutter flush with the pool wall;

securing the flange to the pool wall with first fastening means that are embedded in the pool wall;

welding the flange to the gutter after said securing step with a continuous bead weld at the intersection of the flange and the gutter;

overlaying the flexible pool lining material onto the flange;

placing a water-tight gasket between the pool lining material and the flange; and compressing the pool lining material and gasket between the flange and a compression strip secured to the flange about the perimeter of the pool with second fastening means.

2. The method of claim 1 wherein the pool lining material of said overlaying step is a fabric-reinforced, polyvinyl chloride pool lining material.

3. The method of claim 1 wherein the compression strip of said compressing step is an extruded polyvinyl chloride strip.

4. The method of claim 1 wherein the compression strip of said compressing step is a 12 gauge, type 304, stainless steel strip.

5. The method of claim 1 wherein the first fastening means of said securing step include stainless steel screws tapped into lead anchors embedded within the pool wall.

6. The method of claim 1 wherein the second fastening means of said compressing step include stainless steel screws tapped through said compression strip, pool liner, and gasket, and into anchoring relationship with said flange.

7. The method of claim 1 wherein the gasket of said placing step includes a silicone sponge gasket.

8. A method for providing water-tight termination below normal water level of a flexible pool lining material for a swimming pool having a stainless steel gutter about its entire perimeter, comprising the steps of:

providing about the entire perimeter of the pool that is to be provided with a flexible pool lining material a continuous stainless steel flange immediately below the gutter such that the flange extends downwardly from the gutter flush with the pool wall;

securing the flange to the pool wall with first fastening means that are embedded in the pool wall;

sealing the flange to the gutter at the intersection of the flange and the gutter;

overlaying the flexible pool lining material onto the flange;

placing a water-tight gasket between the pool lining material and the flange; and compressing the pool lining material and gasket between the flange and a compression strip secured to the flange about the entire perimeter of the pool with second fastening means.

9. The method of claim 8 wherein the pool lining material of said overlaying step is a fabric-reinforced, polyvinyl chloride pool lining material.

10. The method of claim 8 wherein the compression strip of said compressing step is an extruded polyvinyl chloride strip.

11. The method of claim 8 wherein the compression strip of said compressing step is a 12 gauge, type 304, stainless steel strip.

12. The method of claim 8 wherein the first fastening means of said securing step include stainless steel screws tapped into lead anchors embedded within the pool wall.

13. The method of claim 8 wherein the second fastening means of said compressing step include stainless steel screws tapped through said compression strip, pool liner, and gasket, and into anchoring relationship with said flange.

14. The method of claim 8 wherein the gasket of said placing step includes a silicone sponge gasket.

15. A method for providing water-tight termination below normal water level of a flexible pool lining material for a swimming pool having a stainless steel gutter about its entire perimeter, comprising the steps of:

providing about the entire perimeter of the pool that is to be provided with a flexible pool lining material a continuous stainless steel flange immediately below the gutter such that the flange extends downwardly from the gutter flush with the pool wall;

sealing the flange to the gutter at the intersection of the flange and the gutter;

overlaying the flexible pool lining material onto the flange;

placing a water-tight gasket between the pool lining material and the flange; and compressing the pool lining material and gasket between the flange and a compression strip secured to the flange about the entire perimeter of the pool with fastening means.

16. The method of claim 15 wherein the pool lining material of said overlaying step is a fabric-reinforced, polyvinyl chloride pool lining material.

17. The method of claim 15 wherein the compression strip of said compressing step is an extruded polyvinyl chloride strip.

18. The method of claim 15 wherein the compression strip of said compressing step is a 12 gauge, type 304, stainless steel strip.

19. The method of claim 15 wherein the fastening means of said compressing step include stainless steel screws tapped through said compression strip, pool liner, and gasket, and into anchoring relationship with said flange.

* * * * *